US011064753B2

(12) United States Patent
Segal

(10) Patent No.: US 11,064,753 B2
(45) Date of Patent: Jul. 20, 2021

(54) DUAL FUNCTIONING HEAD PROTECTION DEVICE

(71) Applicant: Medical Justice Corp., Greensboro, NC (US)

(72) Inventor: Jeffrey Segal, Greensboro, NC (US)

(73) Assignee: Medical Justice Corporation, Greensboro, NC (US)

( * ) Notice: Subject to any disclaimer, the term of this patent is extended or adjusted under 35 U.S.C. 154(b) by 215 days.

(21) Appl. No.: 16/353,760

(22) Filed: Mar. 14, 2019

(65) Prior Publication Data

US 2020/0288808 A1 Sep. 17, 2020

(51) Int. Cl.
*A42B 3/12* (2006.01)
*A42B 3/32* (2006.01)
(Continued)

(52) U.S. Cl.
CPC ..... *A42B 3/122* (2013.01); *A41D 13/018* (2013.01); *A41D 13/0155* (2013.01);
(Continued)

(58) Field of Classification Search
CPC combination set(s) only.
See application file for complete search history.

(56) References Cited

U.S. PATENT DOCUMENTS 3,765,412 A 10/1973 Ommaya et al.
4,324,005 A * 4/1982 Willis ..... A42B 3/0486 2/413
(Continued)

FOREIGN PATENT DOCUMENTS

DE 19754541 A1 6/1999
WO WO2007/050024 A1 5/2007
(Continued)

OTHER PUBLICATIONS

DiCesare C, Foss K, Thomas S, et al. The effects of external jugular compression applied during high intensity power, strength, and postural control tasks. Curr Res Concussion. 2017. DOI https://doi.org/ 10.1055/s-0037-1606580.
(Continued)

*Primary Examiner* — Khaled Annis
(74) *Attorney, Agent, or Firm* — Fox Rothschild LLP

(57) ABSTRACT

A dual functioning head protection device for a fall prone user including a c-shaped neck collar that is configured to compress the jugular veins of the user during application to the user's neck and an expandable airbag helmet that is removably affixed to the collar. The airbag helmet includes an inflatable inner bag surrounded by an outer bag, such that the structure of the outer bag defines a shape of the airbag helmet when the inner bag is inflated. The inner bag includes a number of chambers which inflate to protect the user's skull during a fall. A trigger device in the collar detects if the user is falling and inflates the airbag helmet in such instances. This dual functioning device also protects the user's brain from brain slosh because of the collar's compression of the user's jugular veins. Compression of the vein sends blood into the skull with each fall impact, which reduces the brain's freedom to jostle around in the skull in a fall.

5 Claims, 3 Drawing Sheets

(51) Int. Cl.

| | |
|---|---|
| ***A42B 3/06*** | (2006.01) |
| ***A41D 13/018*** | (2006.01) |
| ***A41D 13/05*** | (2006.01) |
| ***A41D 13/015*** | (2006.01) |

(52) U.S. Cl.
CPC ..... *A41D 13/0512* (2013.01); *A42B 3/069* (2013.01); *A42B 3/32* (2013.01); *A42B 3/322* (2013.01); *A41D 2400/14* (2013.01); *A41D 2600/102* (2013.01)

(56) References Cited

U.S. PATENT DOCUMENTS

| | | | | |
|---|---|---|---|---|
| 4,685,151 | A * | 8/1987 | Kincheloe | A42B 3/0486 2/456 |
| 5,402,535 | A * | 4/1995 | Green | A41D 13/018 128/DIG. 23 |
| 7,150,048 | B2 | 12/2006 | Buckman | |
| 9,173,660 | B2 | 11/2015 | Smith et al. | |
| 10,001,346 | B2 | 6/2018 | Augustine et al. | |
| 10,618,492 | B2 * | 4/2020 | Aranzulla | B60R 21/21 |
| 2005/0067816 | A1 * | 3/2005 | Buckman | A61B 5/6804 280/730.1 |
| 2006/0107952 | A1 * | 5/2006 | Schlosser | A41D 13/018 128/202.19 |
| 2006/0242746 | A1 * | 11/2006 | Hashash | A41D 13/018 2/69 |
| 2008/0282453 | A1 * | 11/2008 | Alstin | A41D 13/0512 2/413 |
| 2010/0004567 | A1 * | 1/2010 | Ishikawa | A61B 5/6807 600/595 |
| 2011/0047684 | A1 * | 3/2011 | Jan | A41D 13/018 2/455 |
| 2011/0288459 | A1 * | 11/2011 | Jenkins, III | A61B 5/11 602/18 |
| 2012/0255099 | A1 * | 10/2012 | Sternberg | A41D 13/0512 2/84 |
| 2013/0205471 | A1 * | 8/2013 | Alvarez | A41D 13/0512 2/202 |
| 2013/0276213 | A1 * | 10/2013 | Olsson | A42B 3/0486 2/413 |
| 2014/0331397 | A1 * | 11/2014 | Kasahara | A41D 13/0512 2/468 |
| 2016/0120238 | A1 * | 5/2016 | Duncan | A41D 13/018 2/462 |
| 2016/0169630 | A1 * | 6/2016 | Augustine | A41D 13/0512 2/468 |
| 2016/0309808 | A1 * | 10/2016 | Armour | A41D 13/0512 |
| 2017/0086514 | A1 | 3/2017 | Everson et al. | |
| 2017/0208874 | A1 * | 7/2017 | Davenport | A41D 1/002 |
| 2017/0277158 | A1 * | 9/2017 | Hyde | A01K 13/006 |
| 2018/0147474 | A1 * | 5/2018 | Hodge | A42B 3/0473 |
| 2019/0099021 | A1 * | 4/2019 | Li | A47G 9/1045 |
| 2019/0125025 | A1 * | 5/2019 | Williams | A42B 3/122 |

FOREIGN PATENT DOCUMENTS

| | | | |
|---|---|---|---|
| WO | WO2017151917 | A1 | 9/2017 |
| WO | WO2017172964 | A1 | 10/2017 |

OTHER PUBLICATIONS

Gu M, Kawoos U, McCarron R, Chavko M. Protection against blast-induced traumatic brain injury by increase in brain volume. Biomed Res Int. 2017. https://doi.org/10.1155/2017/2075463.

Myer G, Barber Foss K, Thomas, S, et al. Altered brain microstructure in association with repetitive subconcussive head impacts and the potential protective effect of jugular vein compression: a longitudinal study of female soccer athletes. Br J of Sports Medicine. 2018. http://dx.doi.org/10.1136/bjsports-2018-099571.

Myer G, Yuan W., et al. Analysis of head impact exposure and brain microstructure response in a season-long application of a jugular vein compression collar: a prospective, neuroimaging investigation in American football. Br J Sports Med 2016; 50; 1276-1285.

Myer G., Yuan W., et al. The Effects of External Jugular Compression Applied during Head Impact Exposure on Longitudinal Changes in Brain Neuroanatomical and Neurophysiological Biomarkers: A Preliminary Investigation. Frontiers in Neurology, Jun. 2016, vol. 7, article 74. doi: 10.3389/fneur.2016.00074.

Sindelar B, Bailes J, Sherman S, et al. Effect of internal jugular vein compression on intracranial hemorrhage in a porcine controlled cortical impact model. J Neurotrauma. 2017; 33: 1703-1709.

Sindelar B, Shinners M, Sherman S, et al. Internal jugular vein compression: A Novel approach to mitigate blast induced hearing injury. Otology and Neurootology. 2017; 38: 591-598.

Smith D, Bailes J, Fisher J, et al. Internal jugular vein compression mitigates traumatic axonal injury in a rat model by reducing the intracranial slosh effect. Neurosurgery 2012; 70: 740-746.

Yeoh T, Venkatraghhavan L, Fisher J, Meineri. Internal jugular vein blood flow in the upright position during external compression and increased central venous pressure: an ultrasound study in healthy volunteers. Can. J. Anesth. 2017; 64: 854-859.

Yuan W., Barber Foss K., et al. White Matter Alterations Over the Course of Two Consecutive High-School Football Seasons and the Effect of a Jugular Compression Collar: A Preliminary Longitudinal Diffusion Tensor Imaging Study. Human Brain Mapping 2017; 39:491-508. Wiley Periodicals, Inc. 2017.

Yuan W., Leach J., et al. Neck Collar with Mild Jugular Vein Compression Ameliorates Brain Activation Changes during a Working Memory Task after a Season of High School Football. Journal of Neurotrauma, 34: 2432-2444;, Aug. 15, 2017.

* cited by examiner

DUAL FUNCTIONING HEAD PROTECTION DEVICE

The present invention is directed towards a device for preventing skull and brain injuries from sudden falls, including injuries caused by brain slosh.

BACKGROUND

Traumatic brain injuries are typically a result of a violent blow or jolt to the head, such as that caused by a sudden and hard fall. Such falls commonly occur when individuals are participating in sports like football, cycling, soccer, or skiing. Sudden and unexpected falls are also common among the elderly who have difficulty with balance and individuals who suffer from seizures caused by epilepsy.

While head helmets are recommended or required during engagement in certain sports to add protection against skull and brain injury from falls, such traditional helmets (both conventional hard shell helmets and expandable airbag helmets) do not eliminate the possibility of brain injury. Rather, it is possible for the individual's skull to be protected by a helmet, but after the skull has come to a stop from the fall or jolt, the brain continues to move via momentum within the skull. The moving brain then hits an immobile skull causing injury, which is commonly referred to as brain slosh. Brain slosh may affect brain cells temporarily; however, in more serious causes, brain slosh can result in bruising, torn tissues, bleeding and other physical damage to the brain. These injuries can result in long-term complications or death.

Thus, there is a need in the art for a dual functioning head protection device that mitigates the risk of skull and brain injuries resulting from violent blows or jolts to the head.

BRIEF SUMMARY

In view of the foregoing background, example implementations of the dual functioning head protection device of the present disclosure include a c-shaped neck collar having first and second ends, the first and second ends being configured to compress a jugular vein on each side of the user during application to the user's neck, and an expandable airbag helmet removably affixed to the collar. The airbag helmet includes an inflatable inner bag surrounded by an outer bag, such that a structure of the outer bag defines a shape of the airbag helmet when the inner bag is inflated. The inner bag includes a number of chambers, each chamber forming a head protection portion when inflated. A trigger device detects if the user is falling and inflates the airbag helmet from the collar when the user is falling.

The airbag helmet includes a neck band portion configured to fit around the user's neck and the collar is removably affixed to an inside of the neck band. The neck band includes a releasable closure and the expandable airbag helmet inflates from the neck band. The releasable closure in the neck band also activates a deployment-ready status for the airbag helmet.

A method of protecting a head of a user is provided, including the steps of compressing a jugular vein on each side of the user with first and second ends of a neck collar, detecting if the user is falling with a triggering device and inflating an airbag helmet that is removably affixed to the collar when the user is falling.

DETAILED DESCRIPTION OF THE PRESENT INVENTION

Figure 1:
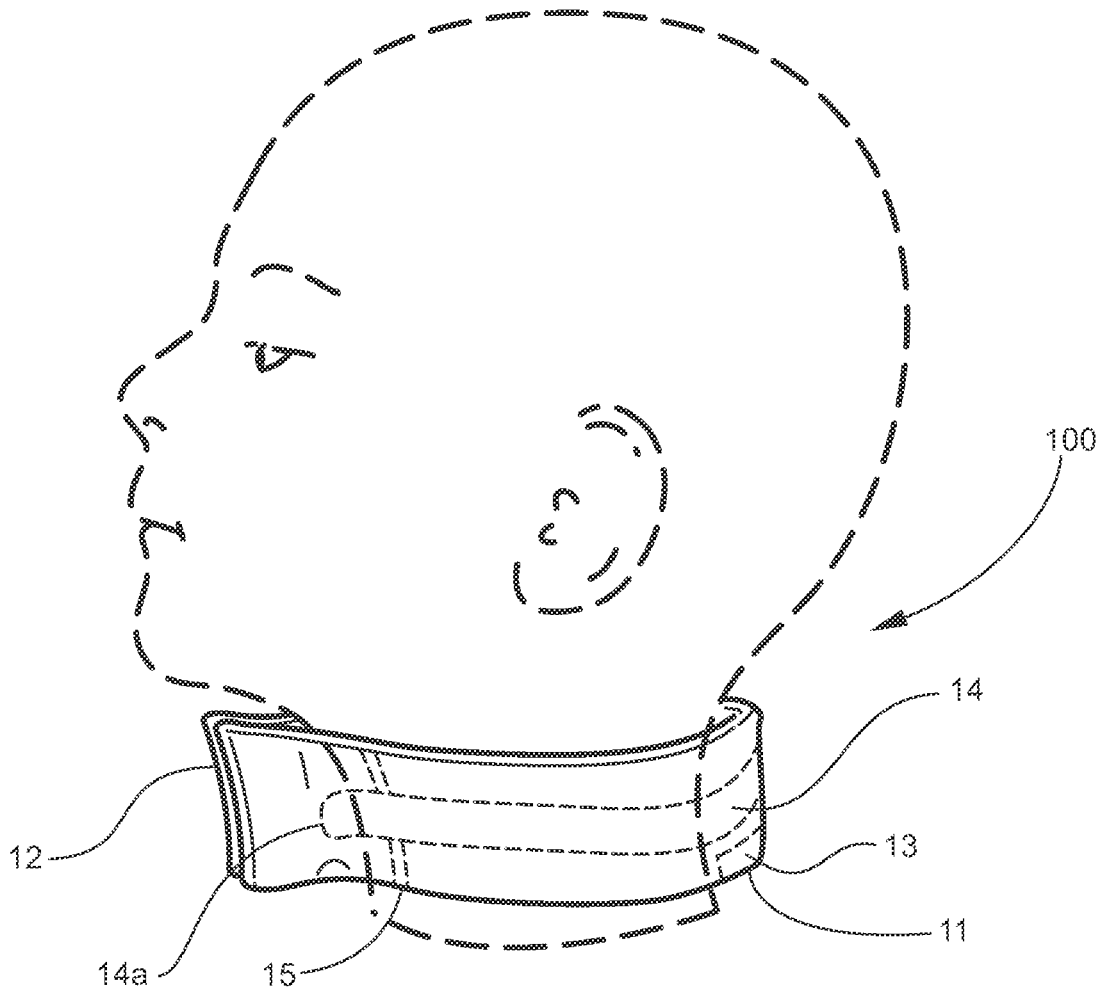
FIG. 1 is a perspective view of a dual functioning head protection device in a non-inflated state, according to an implementation of the present disclosure.

Some implementations of the present disclosure will now be described more fully hereinafter with reference to the accompanying drawings, in which some, but not all implementations of the disclosure are shown. Indeed, various implementations of the disclosure may be embodied in many different forms and should not be construed as limited to the implementations set forth herein, rather, these example implementations are provided so that this disclosure will be thorough and complete, and will fully convey the scope of the disclosure to those skilled in the art. For example, unless otherwise indicated, reference to something as being a first, second or the like should not be construed to imply a particular order. Also, something described as being above something else (unless otherwise indicated) may instead be below, and vice versa, and similarly, something described as being to the left of something else may instead be to the right, and vice versa. Like reference numerals refer to like elements throughout.

The present invention is a device 100 for protecting a user's head from injury as a result of violent blows or jolts to the head, such as from sudden falls. As shown in the Figures, the device 100 generally includes two components that provide head protection, including a compression collar 14 and an expandable airbag helmet 20, which are uniquely integrated to provide effective protection of the user's skull and brain.

Figure 2:
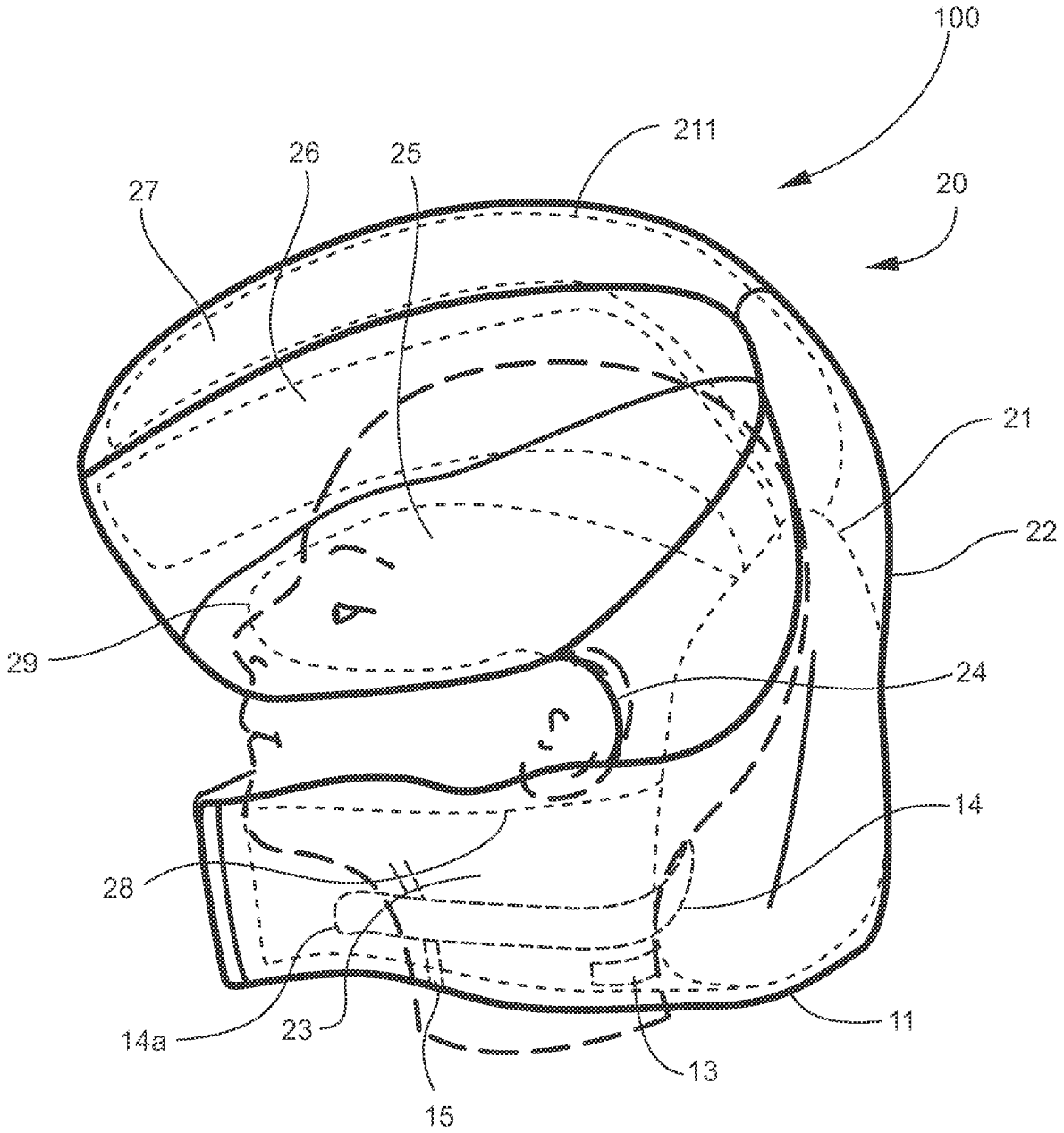
FIG. 2 is a perspective view of a dual functioning head protection device in an inflated state, according to an implementation of the present disclosure.
Figure 3:
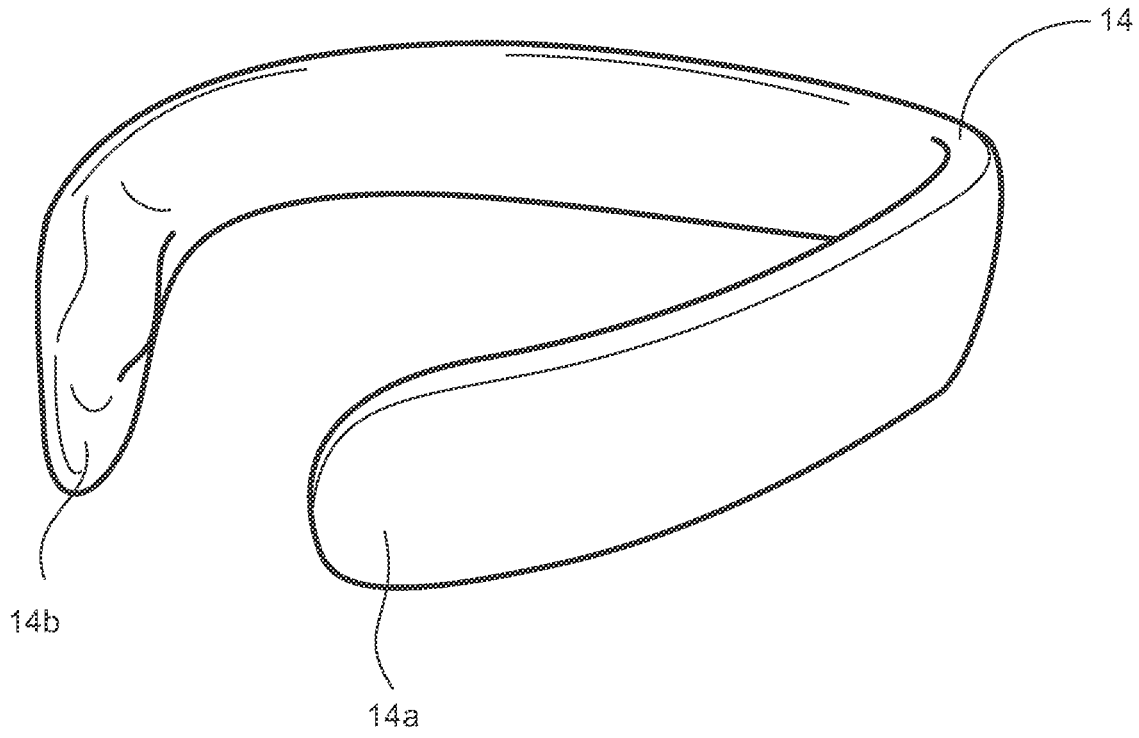
FIG. 3 is a perspective view of a compression collar that is used in connection with a dual functioning head protection device in accordance with an implementation of the present disclosure.

The expandable airbag system of the device 100 is similar to that which is taught in US 2013/0276213 to Olsson et al. Specifically, as shown in FIGS. 1 and 2, the airbag helmet 20 is enclosed within a generally flexible article surrounding the user's neck, referred to herein as the neck band 11. The neck band 11 may include a joint portion with a releasable closure 12 such as a zipper, hook and loop, or snaps that connect the ends of the neck band 11 together. The closure 12 facilitates easy application and removal of the neck band 11 by the user. Additionally, in some embodiments of the present disclosure, the closure activates the airbag helmet 20 into a deployment-ready status. For example, if the closure 12 comprises a zipper with a zip tag, once the device 100 has been applied and closed with the zipper, positioning the zip tag to a designated clip or button on a designated side of the neck band 11 may activate the airbag helmet 20 so that it is ready for deployment. The airbag helmet 20 may be deactivated by unclipping zip tag. Alternatively, the device 100 may include an activation button or switch that is separate and apart from the closure 12. Any such airbag helmet 20 activation means may include status indicators, such as lights indicating whether the airbag helmet 20 is in an activation mode, a deactivation mode, or when the batteries are running low. When the airbag helmet 20 of the device 100 is deactivated, or if the batteries are dead, the airbag can't inflate.

The device 100 may further comprise a detection device 13, such as an accelerometer, configured to trigger inflation of the airbag helmet 20 by an inflation device upon detection of a sudden fall or violent jolt to the user's head (hereinafter referred to as a "fall situation"). The inflation device may be any suitable type of airbag inflation device, such as an inflation device using solid fuel, such as pellets, or a hybrid generator using a combination of compressed gas and solid fuel. In an embodiment, the inflation device is a cold gas inflator. The detection device 13 is preferably configured to detect the movements of the user and, when determining that the user's movements correspond to a fall situation, transmitting a triggering signal to the inflation device. The airbag helmet 20 is consequently inflated when the inflation device receives the triggering signal from the detection device 13 and is activated.

FIG. 2 depicts the airbag helmet 20 in a nearly fully inflated state. In an embodiment of the present disclosure, the airbag helmet 20 comprises an inner bag 21 suitable for inflation and which is surrounded by an outer bag 22. Inflation of the inner bag 21 leads to expansion of the outer bag 22 such that the structure of the outer bag 22 defines the shape of the airbag helmet 20 upon inflation of the inner bag 21. The outer bag 22 is made of a standard airbag material, such as polyamide. The outer bag 22 does not necessarily have to be fluid-impermeable, because the inner bag 21 is capable of expanding the outer bag 22. The material of the inner bag 21 may be a highly elastic material, such as thermoplastic polyurethane film.

In an example implementation of the present disclosure, the outer bag 22 of the airbag helmet 20 includes a number of sections 23, 24, 25, 26, 27. Each respective section 23, 24, 25, 26, 27 is suitable for incorporating at least one of a number of elongated chambers 28, 29 of the inner bag 21. The sections 23, 24, 25, 26, 27 enable control of the speed of inflation in the respective sections, as well as control of the size and shape of the airbag helmet 20 after expansion. As an example, because each section 23, 24, 25, 26, 27 has a maximum inner volume, during use certain sections 23, 25, 26, 27 may be fully expanded while other sections, such as section 24 suitable for surrounding the ears, may be left non-expanded, or substantially non-expanded. This promotes individual control of the shape and speed of inflation of the helmet 20.

The inflation of the inner bag 21 and the unfolding of the airbag helmet 20 is a generally sequential process. Upon inflation, the airbag helmet 20 is first unfolded from the neck band 11 to form the protective helmet shape. At this point, the airbag has a certain pressure for causing the unfolding and shaping of the helmet, but still not enough pressure for providing sufficient protection. Such first step is preferably performed within approximately 50 ms from the start of the inflation. As a second step, the pressure within the inner bag 21 is built up to a protective pressure, i.e. a pressure providing sufficient protection for a user. Typically, the time for achieving this pressure is about 100-150 ms from the start of the inflation. As the inflation process is still running, the pressure within the inner bag 21 increases up to a maximum pressure, which typically is provided after about 300 ms from the start of the inflation.

Because fluid cannot easily leave a fluid impermeable airbag helmet 20, a person wearing the helmet 20 according to the invention will be protected by the airbag 20 for some period of time after expansion, thereby effectively protecting the head of the user for some time, such as when tumbling over after a fall scenario. More specifically, the pressure in the helmet 20 eventually evacuates, but at a much lower rate than the expansion such that the minimum required protective pressure is maintained for a predetermined time, such as two seconds, or even more.

In additional embodiments of the present disclosure, the device 100, and specifically, the airbag helmet 20, may include one or more monitoring, recording and/or communicating devices (not shown). For example, the device 100 may include a sensor that detects environmental parameters around the user, one or more physiological parameters of the user, or some combination thereof. Example environmental parameters may include the time the device 100 was activated, the barometric pressure, ambient temperature, humidity, acceleration/deceleration (G forces), and positionality (upright/supine), etc. Example physiological parameters may include the user's pulse, blood pressure, dermal temperature, oxygen saturation, and blood sugar.

While the prior art airbag helmets similar to those described above provide on-demand skull protection in a fall scenario, there are some limitations to use of the airbag helmet alone without a compression collar 14 as taught further below. For example, the neck band 11 which houses the expandable helmet is battery operated and must be activated to discharge. If the battery runs out or the user forgets to activate the device 100, the helmet 20 will not deploy in a fall situation. Similarly, if a user de-activates the device 100 because the user is temporarily in a "safe position" and then forgets to reactivate the device 100 when the user moves out of the safe position, the user will not be fully protected from skull damage in a fall scenario. Airbag helmets may be plagued with false positives and false negatives. A false positive occurs when the helmet discharges when there is no need (no fall scenario). A false negative occurs when the helmet does not discharge even though there is a fall scenario. If a user experiences a false negative (while falling), and the helmet does not activate and discharge, there is no protection for the user's skull. Thus, it is difficult to persuade users to wear an airbag helmet if the false negative rate is anything higher than negligible. Additionally, a traditional airbag helmet blows up and is "one and done." So if the user falls and hit his or her head more than once, such as if the user falls down the stairs, the brain continues to move and hit the skull internally during the extended fall scenario. If falling forward, the skull stops, but brain keeps on moving and hits front of skull. Similarly, if person falls backwards, the skull stops, and the brain hits the back of the skull. A similar dynamic occurs in side to side brain sloshing.

Having a backup and/or additional head protection is helpful to prevent or mitigate brain injury in the event of a fall. Thus, the present disclosure uniquely integrates the airbag helmet 20 as described above with a mechanical compression feature provided by the collar 14 to increase protection against brain slosh during a fall scenario, as explained below.

Certain animals, such as woodpeckers, bats, and sheep, have natural bodily behaviors that prevent injury resulting from their brains hitting their skulls while engaging in activity causing blunt force to the head. The common protective mechanism with these animals is a muscle, called the omohyoid, which places pressure on the jugular veins, thereby sending blood into the skull with each impact and reducing the brain's freedom to jostle around.

The device 100 of the present disclosure similarly compresses the user's jugular veins 15 with each end 14*a*, 14*b* of a compression collar 14 that is removably affixed (such as via hook and loop or other fasteners) to the inside of the neck band 11 that is fitted around the user's neck to mirror what these animals are able to achieve. The collar 14 is rigid, yet flexible, and has pressure points to mechanically compress the jugular veins while reducing or eliminating pressure on the trachea as not to interfere with breathing. The c-shaped collar 14 has a curved profile to keep it low on the neck of the user, and may be manufactured in various sizes to accommodate various neck circumferences. The collar 14 includes pressure tips on each end 14*a*, 14*b* that enable pressure to be applied in the appropriate location of the jugular veins 15 while providing comfort and preventing movement of the collar 14. Thus, in the event of impact, the brain is protected by increased blood volume in vessels around the brain, acting as a metaphorical bubble wrap. Specifically, the extra fluid in the cerebral veins cushions against a moving brain hitting an immobile skull by preventing excess outflow of blood back to the chest. In some embodiments of the present disclosure, cranial blood volume is increased by at least 3 cm through application of at least 5 mmHg of neck pressure.

An additional benefit of the compression collar 14 is the protection it provides to the user's inner ear during deployment of the airbag helmet 20. More specifically, a deploying airbag is very loud as the associated cartridge explodes and releases gas to fill the airbag. Such loud sounds can damage the user's inner ear and cochlea by causing hearing loss or even deafness. It is known that the cochlear aqueduct is in direct communication with the cerebrospinal fluid and the vein of the aqueduct drains directly into the interior petrosal sinus or jugular vein, or travels through other venous sinuses via the vein of the vestibular or cochlear aqueduct. By the collar 14 compressing the jugular veins 15, thereby resulting in reduced outflow of the veins, the cochlear vein is congested and takes up the compliance of the inner ear. This can protect the inner ear during the loud explosion of the airbag.

An example collar that places such mechanical pressure on the user's jugular veins to protect the brain and ears is the Q-Collar as marketed and sold by Q30 and depicted in US D817.504. Exemplary collars 14 may include an outer portion consisting of a thermoplastic elastomer (durometer 80 Shore A), an inner collar consisting of a thermoplastic elastomer (durometer 50 Shore A), and an insert which may be formed of stainless memory steel composite.

The integrated compression collar 14 and airbag helmet 20 of the present disclosure provides for increased protection from skull and brain injuries over prior art devices, while still providing a relatively inconspicuous and non-constricting device 100.

There is a significant need in the marketplace for the foregoing-described device having dual protection of the skull from fracture and protection of the brain from brain slosh, particularly for users who suffer from fall prone medical conditions such as epilepsy. Approximately 40% of epilepsy population is resistant to medication. See "What can we do for people with drug-resistant epilepsy?," Engel, J., Neurology. 2016; 87: 2483-2489. In spite of medication, such patients still experience seizures, often associated with falls. A fall can cause a head/brain injury creating additional morbidity or even mortality. The mortality rate of patients with medication resistant epilepsy is 5-10 times that of the general population. For years, the solution for epilepsy patients was to wear a hard-shell helmet all day long to address the infrequent event of a seizure/fall. Because the timing of a seizure is not predictable, the helmet had be worn during waking hours. Very few patients, if any, do this. Wearing a hard-shell helmet is uncomfortable, inconvenient, and stigmatizing. So, while a hard-shell helmet may solve a number of issues with seizures/falls, it has not been embraced by the market as a practical solution.

Even with respect to the elderly, many elderly Americans prefer to live alone or in environments with minimal assistance. Such elderly individuals can be at risk for falls, especially if they struggle with balance issues. The Center for Disease Control and Prevention notes that falls are the leading cause of injury and death in older Americans. For example, in 2014 alone, older Americans experienced 29 million falls causing seven million injuries and costing an estimated $31 billion in annual Medicare costs.

The dual functioning head protection device of the present disclosure is additionally needed by athletes, such as cyclists who don't always want to wear a rigid helmet but who want protection from false negatives caused by airbag helmets (when the helmet did not trigger as anticipated in a fall scenario).

These targeted populations, such as medication-resistant epileptics, the elderly, and athletes, would greatly benefit from the dual functioning head protection device described in the present disclosure because it is convenient, relatively inconspicuous, non-intrusive, easy-to-use, and protects both the skull and brain from a fall. This is a marked improvement over prior art hard shell helmets that are cumbersome and stigmatizing, which makes users not want to wear them. This is also a marked improvement over prior art airbag helmets that protect only the skull from a fall scenario and do not mitigate the risk of traumatic brain injuries from brain slosh. The dual protection device of the present disclosure is limited to placement around the neck and, therefore, is not stigmatizing, uncomfortable, or cumbersome. It can also easily be worn by the user during all waking hours, thereby raising user compliance. The dual protection device is also more reliable in protecting against a broader range of head injuries because it provides some level of protection if either component (compression collar or airbag helmet) fails to execute or fails to protect properly.

While certain embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the present disclosure.

What is claimed is:

1. A head protection device for a user comprising:

a rigid c-shaped neck collar having first and second ends, the first and second ends being configured to compress a jugular vein on each side of the user during application to the user's neck;

an expandable airbag helmet removably affixed to the collar, the airbag helmet comprising an inflatable inner bag surrounded by an outer bag, wherein:

a structure of the outer bag defines a shape of the airbag helmet when the inner bag is inflated, the inner bag comprises a plurality of chambers, each chamber forming a head protection portion when inflated, and a trigger device that detects if the user is falling and inflates the airbag helmet from the collar when the user is falling;

wherein the collar is configured to compress the jugular vein on each side of the user when the expandable airbag helmet is in each of deflated and inflated states.

2. The head protection device of claim 1 wherein the airbag helmet comprises a flexible neck band portion configured to fit around the user's neck and wherein the collar is removably affixed to an inside of the neck band.

3. The head protection device of claim 2 wherein the neck band comprises a releasable closure.

4. The head protection device of claim 3 wherein the expandable airbag helmet inflates from the neck band.

5. A method of protecting a head of a user comprising the steps of:

compressing a jugular vein on each side of the user with first and second ends of a rigid neck collar, detecting if the user is falling with a triggering device, and inflating an airbag helmet that is removably affixed to the collar when the user is falling, wherein:

the airbag helmet comprises an inflatable inner bag surrounded by an outer bag, a structure of the outer bag defines a shape of the airbag helmet when the inner bag is inflated, and the inner bag comprises a plurality of chambers, each chamber forming a head protection portion when inflated; and wherein the collar is configured to compress the jugular vein on each side of the user when the airbag helmet airbag helmet is in each of deflated and inflated states.

* * * * *